United States Patent [19]

Golicz et al.

[11] Patent Number: 4,617,784

[45] Date of Patent: Oct. 21, 1986

[54] APPARATUS FOR STACKING AND BANDING TAGS

[75] Inventors: Roman M. Golicz, Clinton; Dana W. Seniff, Guilford, both of Conn.; Ronald L. Fogle, Lebanon; Orville C. Huggins, Dayton, both of Ohio

[73] Assignee: Monarch Marking Systems, Inc., Dayton, Ohio

[21] Appl. No.: 815,182

[22] Filed: Dec. 23, 1985

Related U.S. Application Data

[63] Continuation of Ser. No. 568,555, Jan. 5, 1984, abandoned.

[51] Int. Cl.[4] ..... B65B 9/02; B65B 35/50

[52] U.S. Cl. ..... 53/540; 53/228; 53/373; 53/553; 53/586; 53/591

[58] Field of Search ..... 53/228, 373, 540, 553, 53/586, 591; 83/213

[56] References Cited

U.S. PATENT DOCUMENTS

| | | | |
|---|---|---|---|
| 2,379,937 | 7/1945 | Sloan | 53/391 |
| 2,578,799 | 12/1951 | Grey | 53/591 X |
| 3,236,024 | 2/1966 | Bradley | 53/586 |
| 3,279,146 | 10/1966 | Ficht | 53/586 |
| 3,580,786 | 5/1971 | Doane | 53/586 |
| 4,279,113 | 7/1981 | Halm | 53/373 X |

FOREIGN PATENT DOCUMENTS

| | | | |
|---|---|---|---|
| 2701251 | 7/1978 | Fed. Rep. of Germany | 53/591 |

*Primary Examiner*—John Sipos

*Attorney, Agent, or Firm*—Joseph J. Grass

[57] ABSTRACT

There is disclosed apparatus for stacking and banding tags. The tag stacks are successively banded and a series of selected number of detachably connected tag stacks are produced.

1 Claim, 9 Drawing Figures

APPARATUS FOR STACKING AND BANDING TAGS

This application is a continuation, of application Ser. No. 568,555, filed Jan. 5, 1984 now abandoned.

BACKGROUND OF THE INVENTION

1. Field of the Invention

This invention relates to the art of stacking and banding tags.

2. Brief Description of the Prior Art

The following U.S. Pat. Nos. are made of record: 2,379,935; 2,379,937; 2,418,054; 2,551,288; 2,578,799; 2,563,071; 2,581,724; 2,741,885; 2,748,550; 2,999,532; 3,140,572; 3,212,507; 3,213,589; 3,262,242; 3,269,089; 3,279,146; 3,321,353; 3,421,284; 3,422,186; 3,457,695; 3,469,365; 3,518,808; 3,580,786; 3,729,885; 3,735,551; 3,838,663; 3,824,908; 4,067,173; 4,169,344; 4,172,347; 4,253,291; 4,307,555.

SUMMARY OF THE INVENTION

The invention relates to apparatus for stacking and banding tags. The tags are typically produced by a high speed printer. The apparatus includes a conveyor that conveys the tags serially from the printer to a stacking station where the tags are accumulated into a stack. When a stack is completed, a transferring member transfers the stack to a banding station. Banding is accomplished using a pair of webs of banding material. As the stack is transferred from the stacking station to the banding station, the stack draws the webs from web rolls. The webs are brought into contact and heat sealed to each other at one location to form a loop about the tag stack using preferably one movable jaw and one stationary jaw. Thereafter, the stacking and banding cycle is repeated. As each heat seal is made the webs are also weakened for example by perforating so that each stack is manually detachable from the adjacent stack. When a series of a selected number of stacks has been banded, the series can be automatically severed, and thereafter additional tags can be stacked and bundled to provide another series of banded tag stacks. The sealing jaws contain web sealing, severing and weakening elements. The sealing and weakening elements operate each time a stack of tags is banded, but the severing element is selectively operated when the series of tag stacks is complete. According to one specific embodiment, an electric motor drives the conveyor and a drive shaft. Whenever it is desired to move the transfer member from its first position to its second position or from its second position to its first position, a single-revolution clutch is operated to drive the transfer member. A speed reducer is preferably used to operate the transfer member through one-half of its cycle for each operation of the clutch. Also, whenever it is desired to move the movable jaw from its first position to its second position or from its second position to its first position, another single-revolution clutch is operated to drive the jaw. A speed reducer is preferably used to move the jaw through one-half of its cycle for each operation of the other clutch. The invention provides relatively simple, compact structure for banding stacks of tags into an easy-to-use series of detachably connected stacks.

DETAILED DESCRIPTION OF A PREFERRED EMBODIMENT

Figure 1:
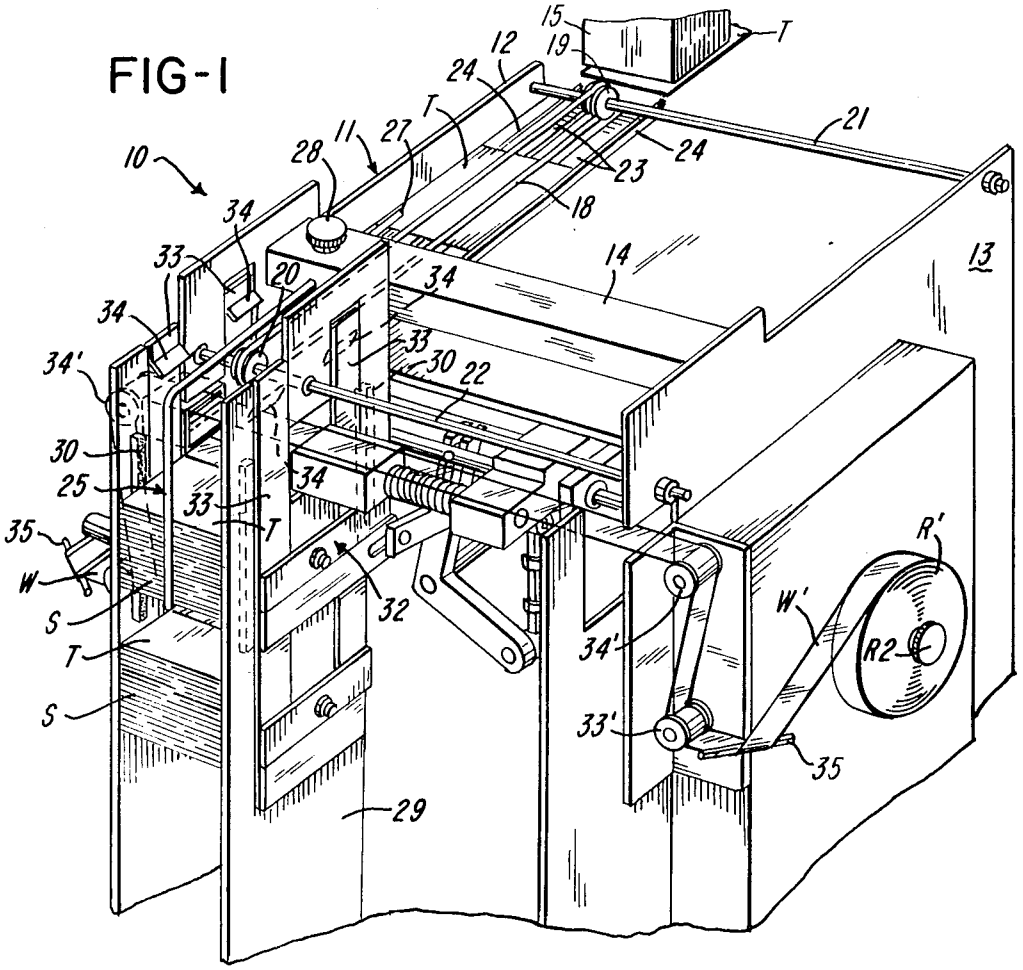
FIG. 1 is a perspective view of a tag stacking and banding apparatus according to the invention.
Figure 2:
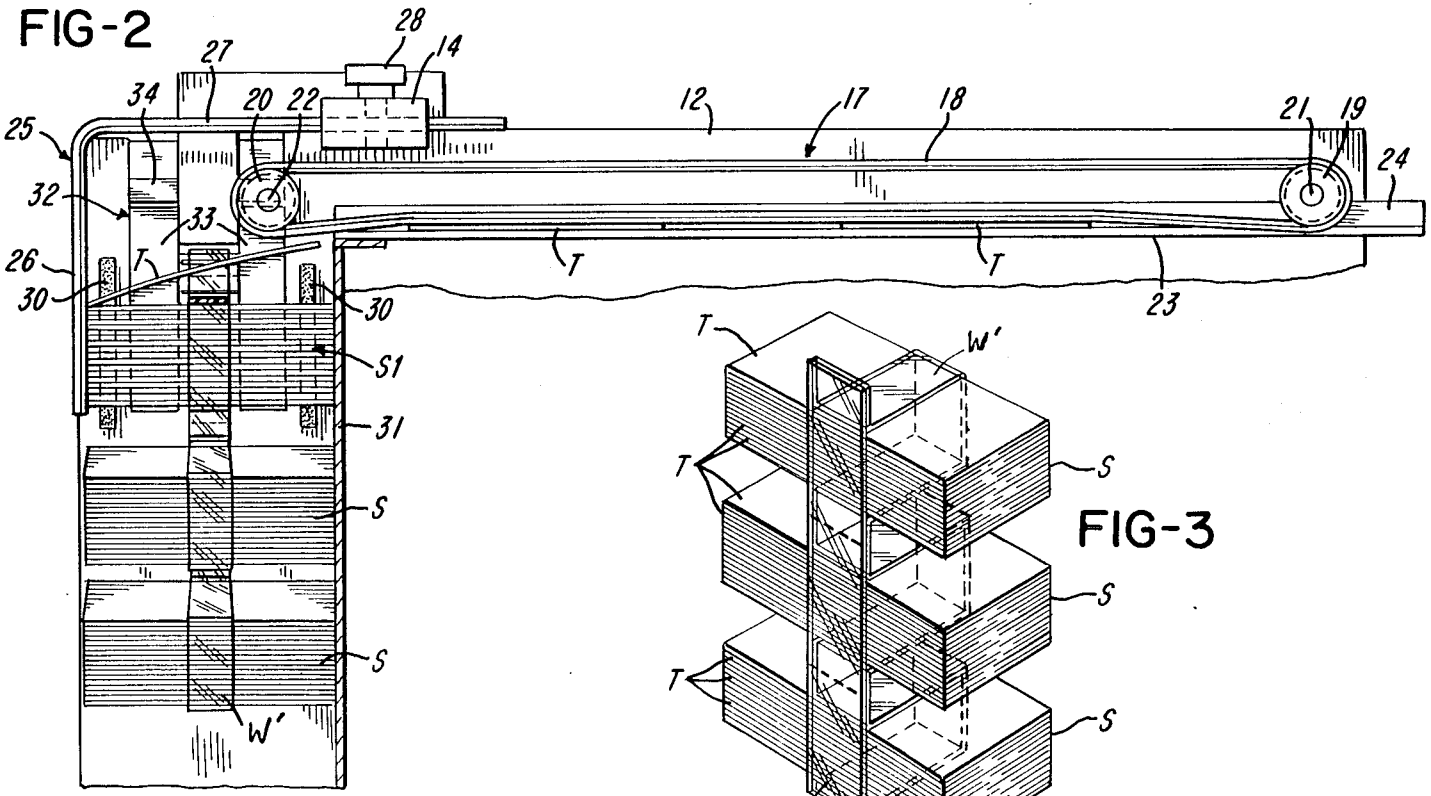
FIG. 2 is a side elevational view of the apparatus of FIG. 1.

With reference to FIG. 1, there is shown an apparatus 10 for stacking and banding tags T. The tags T are accumulated in a stack S at a stacking station S1 and the stack S is thereafter transferred to a banding station S2. The apparatus 10 includes a frame 11 shown to have spaced frame plates 12 and 13. The plates 12 and 13 are connected by suitable structural members including member 14. A printer 15 serially prints data on the tags T. The tags T pass from the printer 15 to a conveyor generally indicated at 17. The conveyor 17 is shown to include an endless belt 18 trained about pulley wheels 19 and 20. The pulley wheels 19 and 20 are rotatably mounted on respective rods 21 and 22 secured to frame plates 12 and 13. A pair of rails 23 supports the tags T and have respective flanges 24 which provide side edge guides for the tags T. The belt 18 is under tension and biases the tags T against the rails 23 as best shown in FIG. 2. The tags T are conveyed serially to the stacking station S1 where the forward tag movement is arrested by a stop 25. The stop 25 is shown to be a bent rod with a vertical portion 26 and a horizontal portion 27 joined at right angles. The horizontal portion 27 is adjustably connected to the member 14 by a set screw 28. By loosening the set screw 28, the stop 25 can be moved forwardly (to the left in FIG. 2) to accommodate longer tags and rearwardly (to the right in FIG. 2) to accommodate shorter tags T. The frame plate 12 and another frame plate 29 mount pairs of one-way friction strips 30 which allow the tags T to descend as shown for the uppermost tag T, but retard any retrograde or upward movement of the tags T. The strips 30 have bristles which are inclined downwardly. There is an upstanding wall 31 spaced from the vertical portion 26 and joined to the frame plates 12 and 29. The tags T are confined between the vertical portion 26 and the wall 31.

Figure 4:
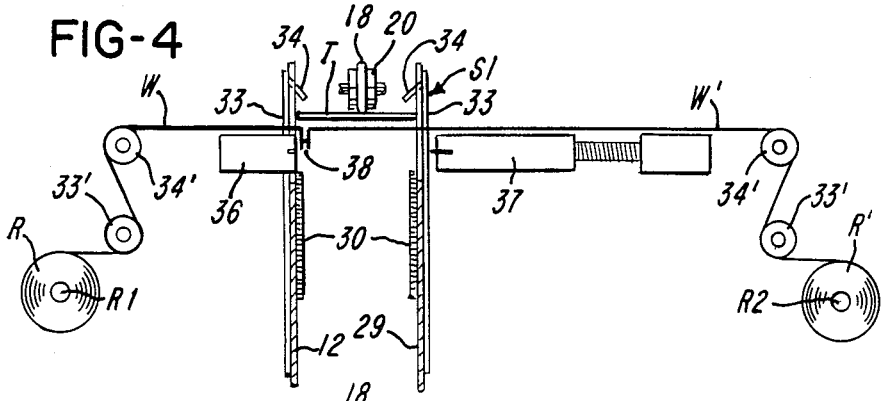
FIG. 4 is a diagrammatic view of the apparatus showing one tag at the stacking station.

A transferring member or slide generally indicated at 32 has two sets of upstanding members 33. Each member 33 has a downwardly extending finger 34. The slide 32 is mounted to frame plates 12 and 29 for reciprocating vertical movement. The slide 32 is originally in a position shown in FIG. 4 and is moved to the position shown in FIG. 5 to move the stack S to the banding station S2. The vertical arrows in FIG. 5 indicate the direction in which the stack S has moved.

With reference to FIGS. 1, 4, 5 and 6, there is shown a pair of webs W and W' of suitable heat sealable banding material, for example a polyethylene and mylar laminate. The webs W and W' are wound into supply rolls R and R' on opposite sides of the frame plates 12 and 13.

The webs W and W' pass about respective rotatable spring-biased tension rolls 33' and guide rolls 34'. In the event the rolls R and R' are mounted on hubs R1 and R2 parallel to parallel frame plates 12 and 13, then a turning bar 35 or the like is also used.

A pair of opposed jaws 36 and 37 are used to seal the webs W and W' to each other locally to provide a heat seal generally indicated at 38. More specifically, the drawings show that the heat seal 38 is comprised of spaced heat seal portions or zones 39. The jaw 36 is preferably stationary and the jaw 37 is slidably mounted for horizontal movement. In the position shown in FIG. 4, marginal portions of the webs W and W' are joined by a heat seal 38. The webs W and W' are in overlying relationship to respective jaws 36 and 37. Although the webs W and W' are shown spaced from the respective jaws 36 and 37 for clarity, the upper surfaces of the jaws 36 and 37 are in supporting and guided contact therewith.

When the slide 32 moves downwardly, the fingers 34 pull the webs W and W' from the rolls R and R'. When the jaw 37 moves from the position shown in FIGS. 4 and 5 to the position shown in FIG. 6, the jaw 37 draws the web W' from the roll R'.

Figure 3:
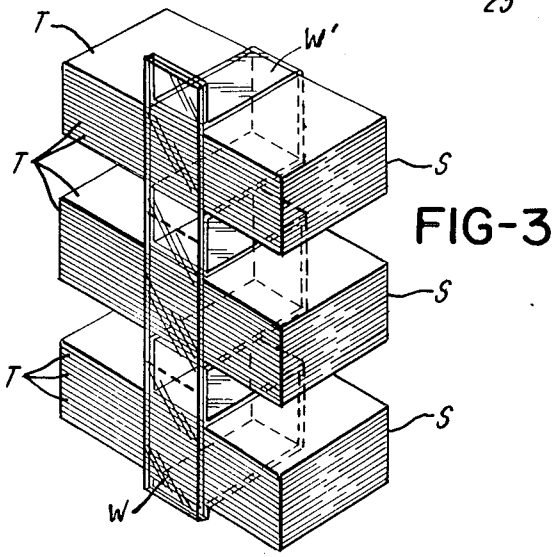
FIG. 3 is a perspective view showing a series of stacks of banded tags.
Figure 5:
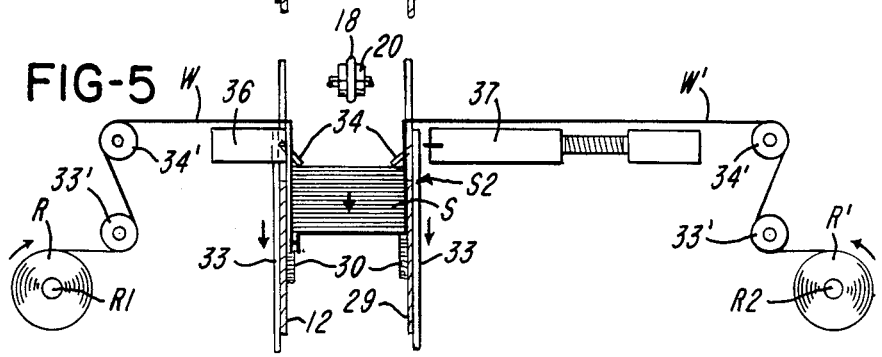
FIG. 5 is a view similar to FIG. 4, but showing the transferring member as having moved a whole stack from the stacking station to the banding station and in so doing having pulled web material from their respective rolls.
Figure 6:
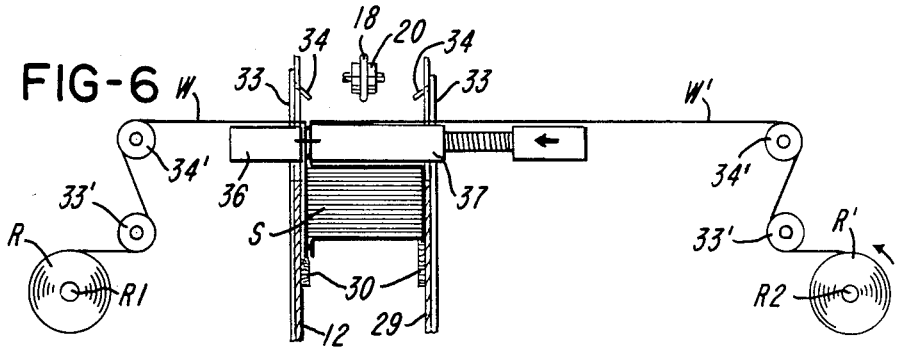
FIG. 6 is a view similar to FIGS. 4 and 5, but showing the jaw as having moved into cooperation with another jaw and in so doing having pulled one of the webs across the side of the stack.
Figure 7:
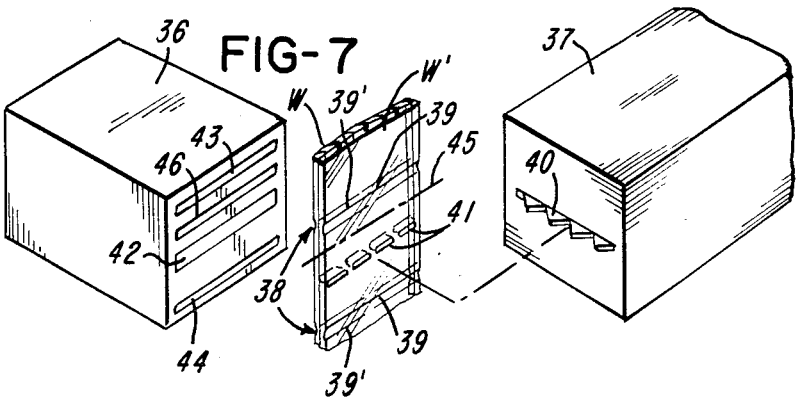
FIG. 7 is a rotated perspective view showing the jaws and the heat sealing and perforating they perform on the webs.

In the position shown in FIG. 5, the end portion of the web W is disposed along one side of the stack S and the end portion of the web W' is disposed across the bottom and along the other side of the stack S at the banding station S2. When the jaw 37 has moved to the position of FIG. 6, the end portion of the web W' is also disposed across the top of the stack S, and the webs W and W' are in contact between and are clamped by the jaws 36 and 37. In the position of FIG. 6, not only are the webs heat sealed at zones 39, but a perforating knife 40 on the jaw 37 makes perforations 41 in the webs W and W'. The jaw 36 has a resilient cushion 42 aligned with the knife 40. The knife 40 can contact the cushion 42 without damage. The jaw 36 also has spaced heat sealing elements 43 and 44 and a heat severing element 46 disposed between the cushion 42 and the heat sealing element 43. The heat sealing elements 43 and 44 heat seal the webs W and W' to each other at the zones 39. The heat severing element 46 can be selectively operated to sever the webs W and W' along a line of severing 45 which is located between the border 39' of the zone 39 and the line of weakening provided by the perforations 41. The line of weakening can be provided by means other than perforations, as by thinning out the webs W and W' at the same location, if desired. If only one stack S of tags T is to be banded and severed along the line 45, then the heat severing element 46 is activated. It is usually desired to provide a series of connected stacks S in which event the severing element 46 is only operated when the desired number of stacks of a series has been banded. FIG. 3 shows three stacks in the series. When making a series of a multiplicity of stacks S, the jaw 37 just returns to the position shown in FIGS. 4 and 5 and the next stack S is accumulated, and when accumulated the fingers 34 move that next stack S downwardly to the FIG. 5 position and thereafter the jaw 37 moves to the left to the position of FIG. 6 and that next stack S is banded, and so on until the series is complete, whereupon the severing element 46 is activated. The banding of tag stacks S in a series is also illustrated in FIG. 2.

Figures 8, 9:
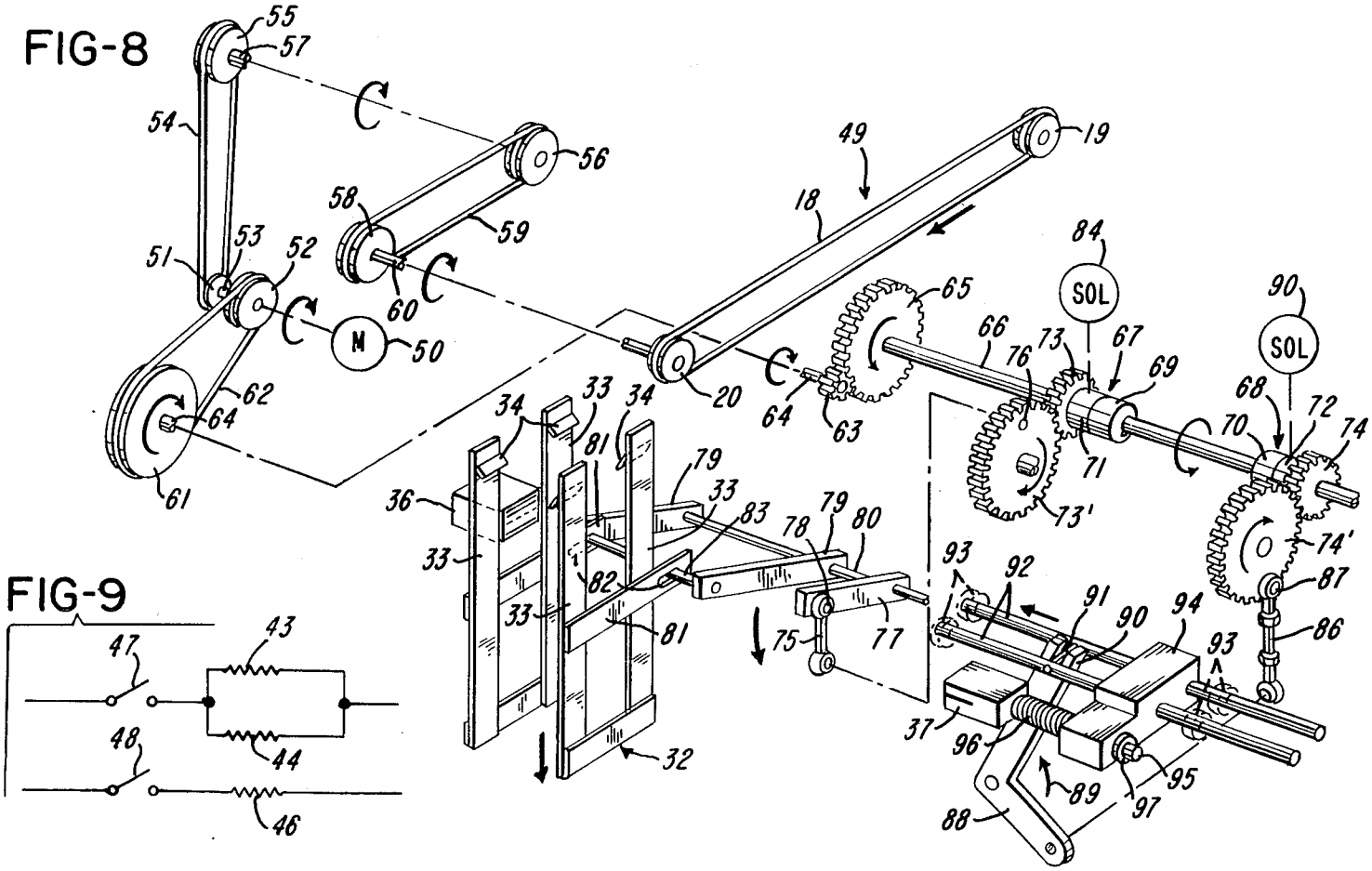
FIG. 8 is an exploded perspective view showing the drive mechanism for the conveyor, the transfer member and the movable jaws.
FIG. 9 is a diagrammatic view showing means for operating heat sealing and severing elements.

FIG. 9 illustrates diagrammatically how closure of switch 47 simultaneously actuates elements 43 and 44 to heat seal along zones 39. Closure of switches 47 and 48 simultaneously activates elements 43, 44 and 46. The elements 43, 44 and 46 are preferably of the impulse type. Both weakening by the illustrated perforations 41 and heat severing along line 45 is accomplished between borders 39' of zones 39.

With reference to FIG. 8, there is shown a drive mechanism generally indicated at 49. An electric motor 50 directly drives pulley wheels 51 and 52 on a shaft 53. The pulley wheel 51 drives a pulley 54 which in turn drives a pulley wheel 55. The pulley wheel 55 and a pulley wheel 56 are secured to a shaft 57. The pulley wheel 56 drives a pulley wheel 58 via a pulley 59. The pulley wheels 20 and 58 are secured to a shaft 60. Thus, the conveyor belt 18 is driven continuously during operation of the motor 50.

The pulley wheel 52 drives a pulley wheel 61 via pulley 62. The pulley wheel 61 and a pinion 63 are secured to a shaft 64. The pinion 63 drives a gear 65 secured to a shaft 66. Single-revolution clutches 67 and 68 are received on the shaft 66. Clutches 67 and 68 have respective clutch parts 69 and 70 secured to the shaft 66 and have respective clutch parts 71 and 72. The clutch part 71 is secured to a pinion 73, and clutch part 72 is secured to a pinion 74. The pinion 73 meshes with a gear 73'. A connecting rod 75 is pivotally connected to the gear 73' at 76 and to an arm 77 at 78. The arm 77 and a pair of arms 79 are secured to a pivotally mounted rod 80. The slide 32 includes arms 81 having elongated slots 82. A rod 83 connected to arms 79 passes through the slots 82.

The clutch 67 is engaged by operation of a electromagnetic means such as solenoid 84. The clutch part 69 rotates as a unit with the shaft 66. Engagement of the clutch 67 causes the clutch parts 67 and 71 to rotate as a unit through one complete revolution. The gear ratio between gears 73 and 73' is 2-to-1 so that for a complete revolution of the gear 73, the gear 73' makes one-half revolution. One-half revolution of the gear 73' causes counterclockwise pivoting of the shaft 80 in the direction of arrow 85 and in turn the slide 32 is moved downwardly to transfer a stack S from the stacking station S1 to the banding station S2. Another actuation of the solenoid 84 causes the gear 73' to make another one-half revolution to move the slide 32 upwardly. Thus, during each complete machine cycle the solenoid 84 is actuated twice.

The pinion 74 meshes with a gear 74'. A connecting rod 86 is pivoted to the gear 74' at 87 and to a bell crank 88 at 89. The clutch 68 is engaged by operation of electromagnetic means such as a solenoid 90. The clutch part 70 rotates as a unit with the shaft 66. Engagement of the clutch 68 causes the clutch parts 70 and 72 to rotate as a unit through one complete revolution. The gear ratio between gears 74 and 74' is 2-to-1 so that for a complete revolution of the gear 74, the gear 74' makes one-half revolution. One-half revolution of the gear 74' causes counterclockwise pivoting of the bell crank 88 in the direction of the arrow 89. The bell crank 88 is forked as shown at 90 and receives a pin 91 secured to spaced rods 92. The rods 92 are guided in bearings 93 shown in phantom. A block 94 is secured to rods 92. A shaft 95 secured to jaw 37 extends through a compression spring 96 and is slidably received in the block 94. A collar 97 adjustably secured to the shaft 95 retains the spring 96 under slight compression. Movement of the bellcrank 88 in the direction of the arrow 89 causes the jaw 37 to move from the position shown in FIGS. 4 and 5 to the position shown in FIG. 6. The spring 96 allows some overtravel of the blocks 94 and allows the jaw 37 to be urged against the jaw 36 with the proper amount of pressure. Another actuation of the solenoid 90 causes the gear 74' to rotate through another one-half revolution to cause the bell crank 88 to pivot clockwise to move the jaw 37 from the position of FIG. 6 to the position of FIG. 5 for example.

Once a stack S has been accumulated at the stacking station Sl, the solenoid 84 is operated to move the stack S to the banding station S2. Thereupon the solenoid 90 can be energized to move the jaw to the position shown in FIG. 6 and to energize heat sealing elements 43 and 44 through closure of the switch 47. In that the jaw 37 moves in a path between the pair of members 33 on the right side of FIG. 8, the solenoid 90 can be energized even before the jaw 37 returns to the FIG. 6 position. In any event, a second energization of the solenoid 90 causes the jaw 37 to return to the FIG. 5 position. In the event it is desired to sever one stack S or a series of stacks from the adjacent stack S or series of stacks, the heat severing element 46 can be operated by closing the switch 48 simultaneously with closure of the switch 47.

Other embodiments and modifications of this invention will suggest themselves to those skilled in the art, and all such of these as come within the spirit of this invention are included within its scope as best defined by the appended claims.

We claim:

1. Apparatus for banding tags, comprising: means for conveying tags serially to a stacking station, the conveying means including a conveyor for moving the tags in a first direction, means for interrupting the movement of the tags as they arrive at the stacking station to provide a tag stack, means providing a path for the first web of banding material to the stacking station, means providing a path for a second web of banding material to the stacking station, means including a transferring member for simultaneously moving the entire tag stack in a second direction across the paths of said first and second webs to a banding station to thereby wrap said stack with said webs, means for attaching the first band to the second band at spaced locations to provide a band about the stack to keep the tags stacked, wherein the band attaching means includes a stationary jaw and a movable jaw cooperable with the stationary jaw, at least one of the jaws having means for heat sealing and weakening the first and second webs between a series of tag stacks, means for moving the transferring member and thereby the stack from a first position in said stacking station to a second position in said banding station including a first single revolution clutch and means for moving the movable jaw from a first nonsealing position to a second sealing position in sealing cooperation with said stationary jaw including a second single-revolution clutch, wherein the moving means includes a 2-to-1 speed reducer coupling the first single-revolution clutch and the transferring member and a 2-to-1 speed reducer coupling the second single-revolution clutch and the jaw, and separate means for actuating said first and second clutches so that one actuation of the first single-revolution clutch moves the transferring member from its first position to its second position and another actuation of the first single-revolution clutch moves the transferring member from its second position to its first position and so that one actuation of the second single-revolution clutch moves the movable jaw from its first position to its second position and another acutation of the second single-revolution clutch moves the movable jaw from its second position to its first position.

* * * * *